US006615434B1

(12) United States Patent
Davis et al.

(10) Patent No.: US 6,615,434 B1
(45) Date of Patent: Sep. 9, 2003

(54) BOWLING LANE CLEANING MACHINE AND METHOD

(75) Inventors: John M. Davis, Sebring, FL (US); Mark E. Davis, Sebring, FL (US)

(73) Assignee: The Kegel Company, Inc., Lake Wales, FL (US)

( * ) Notice: Subject to any disclaimer, the term of this patent is extended or adjusted under 35 U.S.C. 154(b) by 0 days.

(21) Appl. No.: 08/131,855

(22) Filed: Oct. 5, 1993

Related U.S. Application Data

(63) Continuation of application No. 07/902,910, filed on Jun. 23, 1992, now abandoned.

(51) Int. Cl.[7] ..... A47L 7/02
(52) U.S. Cl. ..... 15/98; 15/302; 15/320
(58) Field of Search ..... 15/302, 98, 319, 15/4, 320

(56) References Cited

U.S. PATENT DOCUMENTS 2,622,254 A * 12/1952 Mendelson ..... 15/320
3,418,672 A * 12/1968 Regan ..... 15/98
3,604,037 A * 9/1971 Varner ..... 15/4
3,753,777 A * 8/1973 Thomsen ..... 15/320
3,942,215 A * 3/1976 Olds ..... 15/320
4,069,540 A * 1/1978 Zamboni ..... 15/320
4,167,798 A * 9/1979 Klugl et al. ..... 15/320
4,351,081 A * 9/1982 Tarkinson ..... 15/320
4,353,145 A * 10/1982 Woodford ..... 15/320
4,363,152 A * 12/1982 Karpanty ..... 15/98
4,586,213 A * 5/1986 Bricher et al. ..... 15/320
4,595,420 A * 6/1986 Williams, III et al. ..... 15/320
4,845,794 A * 7/1989 Korski et al. ..... 15/320
4,910,824 A * 3/1990 Nagayama et al. ..... 15/98
4,920,604 A * 5/1990 Ingermann et al. ..... 15/98
4,956,891 A * 9/1990 Wulff ..... 15/320
5,287,581 A * 2/1994 Lo ..... 15/98

* cited by examiner

*Primary Examiner*—Frankie L. Stinson
(74) *Attorney, Agent, or Firm*—Hovey Williams LLP

(57) ABSTRACT

As the cleaning machine travels along the lane from the foul line toward the pin deck area, cleaning liquid is sprayed onto the lane surface in periodic discharges of relatively short duration. A soft, thin web of cloth material immediately behind the spray nozzles is looped under a transverse cushion or backup member and is pressed against the wetted lane surface to spread and meter out the liquid into a thin film that passes beneath the cushion as a bead or shallow pool of the liquid is pushed along ahead of the cushion. The film is subsequently lifted entirely off the lane surface to remove all traces of moisture, oil, and grime by a combination squeegee and vacuum head assembly immediately behind the spreading web assembly. Programmable controls on the machine permit the cleaning functions to be carried out in relation to the position of the machine on the lane.

24 Claims, 11 Drawing Sheets

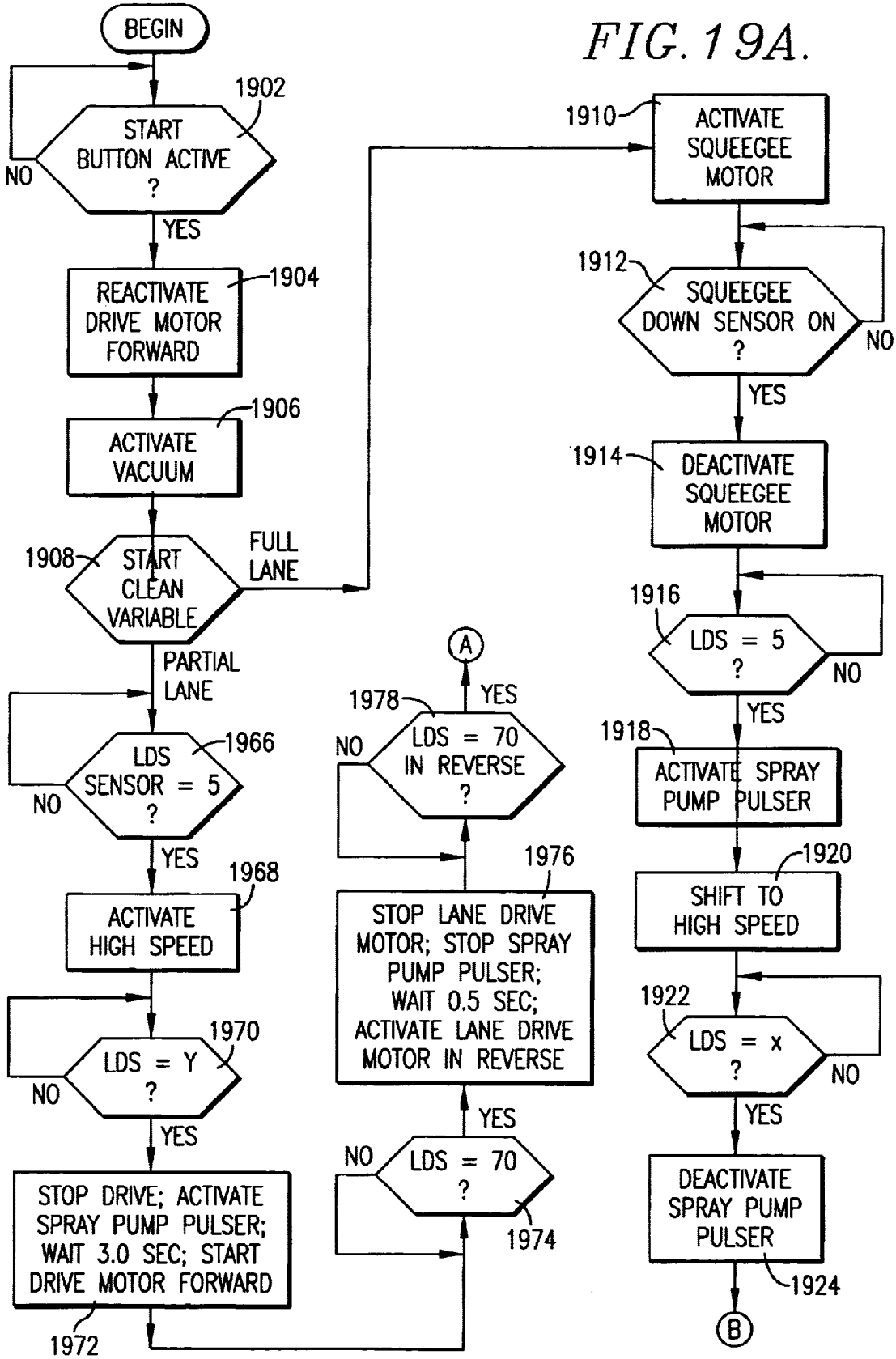
FIG. 19A.
BEGIN
1902
START BUTTON ACTIVE ?
NO
YES
1904
REACTIVATE DRIVE MOTOR FORWARD
1906
ACTIVATE VACUUM
1908
START CLEAN VARIABLE
FULL LANE
PARTIAL LANE
1966
LDS SENSOR = 5 ?
NO
YES
1968
ACTIVATE HIGH SPEED
1970
LDS = Y ?
NO
YES
STOP DRIVE; ACTIVATE SPRAY PUMP PULSER; WAIT 3.0 SEC; START DRIVE MOTOR FORWARD
1972
1910
ACTIVATE SQUEEGEE MOTOR
1912
SQUEEGEE DOWN SENSOR ON ?
NO
YES
1914
DEACTIVATE SQUEEGEE MOTOR
1916
LDS = 5 ?
NO
YES
1918
ACTIVATE SPRAY PUMP PULSER
1920
SHIFT TO HIGH SPEED
1922
LDS = x ?
NO
YES
DEACTIVATE SPRAY PUMP PULSER
1924
B
A
1978
LDS = 70 IN REVERSE ?
YES
NO
1976
STOP LANE DRIVE MOTOR; STOP SPRAY PUMP PULSER; WAIT 0.5 SEC; ACTIVATE LANE DRIVE MOTOR IN REVERSE
YES
NO
LDS = 70 ?
1974

BOWLING LANE CLEANING MACHINE AND METHOD

This is a continuation of application Ser. No. 07/902,910, filed Jun. 23,1992 and abandon.

TECHNICAL FIELD

The present invention relates to the cleaning of bowling lanes to remove previously applied oil layers and the associated grimy dirt and dust prior to placement of a new, clean film of oil on the lane. More particularly, it relates to a new method and apparatus for using a lane cleaning solvent in a more efficient way than heretofore possible, while at the same time achieving more effective cleaning results.

BACKGROUND

Bowling lanes must be periodically cleaned to remove dirt and grime, as well as previously applied, thin films of oil before a new layer of oil is laid down. A number of different machines are currently available for accomplishing this cleaning function, several of which spray a liquid cleaner on the surface of the lane and immediately pick it back up from the lane surface using a squeegee and vacuum head associated with the machine as the machine moves from the foul line down toward the pin deck area. While these machines are satisfactory in many respects, they also use a great deal of cleaner and tend to leave a film residue on the lane due to incomplete pickup by the squeegee and vacuum head.

SUMMARY OF THE PRESENT INVENTION

Accordingly, one important object of the present invention is to provide a new method of cleaning the oil layer and dirty grime from the surface of a bowling lane which is significantly more efficient in terms of the amount of cleaning liquid used than prior techniques, yet which does not sacrifice the cleaning quality and in fact actually increases the overall level of cleaning performance. In this regard, it is also an important object of the present invention to provide a novel machine or apparatus for carrying out the improved cleaning method of the present invention.

In furtherance of these objectives, the present invention contemplates using the cleaning solvent much more sparingly than in the past. Solvent which is applied to the lane to loosen the oil and grime from the lane surface is acted upon by a spreader element before ever approaching the liquid with the pickup squeegee so that the liquid resting on the lane is metered into a thin, evenly distributed film before being engaged and uplifted from the lane surface by the pickup squeegee and associated suction head. As the spreader element moves along the lane surface, it pushes ahead of itself a small pool or bead of the liquid while allowing only a thin, metered film to actually pass beneath the element back to the pickup area of the machine. Preferably, the liquid is sprayed onto the lane in intermittent discharges of such duration and frequency that although there is always a small bead of liquid pushed ahead of the wiping element, such bead of liquid does not become excessively large. On the other hand, the discharge is frequent enough that the wiping element never fails to have a bead of liquid associated along its lower front margin.

The wiping element is preferably comprised by a point of tangential engagement between a web of absorbent material looped under an arcuate contour, such as the lower margin of a cushion roller, and the lane surface. Some of the oil, liquid, and dirt is picked up by the wiping web itself due to its absorbent nature, but a large portion of such materials pass in the thin film beneath the material web back to the squeegee, where they are totally removed from the lane's surface, preferably by a suction head.

The web of material is controlled by a specially operated pay out roller and takeup roller so that a fresh area of the web is presented to the lane surface after the completion of a pass down the bowling lane and at the commencement of the return trip back toward the foul line. Programmable controls associated with the web takeup mechanism and the squeegee, as well as the discharging nozzle, permit the operation of the machine to be coordinated with travel along the lane surface. Preferably, the cleaning apparatus of the present invention, and the method associated therewith, are incorporated into a machine which can automatically index itself from one lane to another without operator intervention, all as disclosed in our application Ser. No. 07/713,725 filed Jun. 11, 1991, and titled BOWLING LANE MAINTENANCE MACHINE CAPABLE OF SELF-INDEXING FROM LANE-TO-LANE.

BRIEF DESCRIPTION OF THE DRAWINGS

FIGS. 19A, 19B and 19C are computer diagram flow charts illustrating the operation of the controller of FIG. 18.

DETAILED DESCRIPTION

Figure 1:
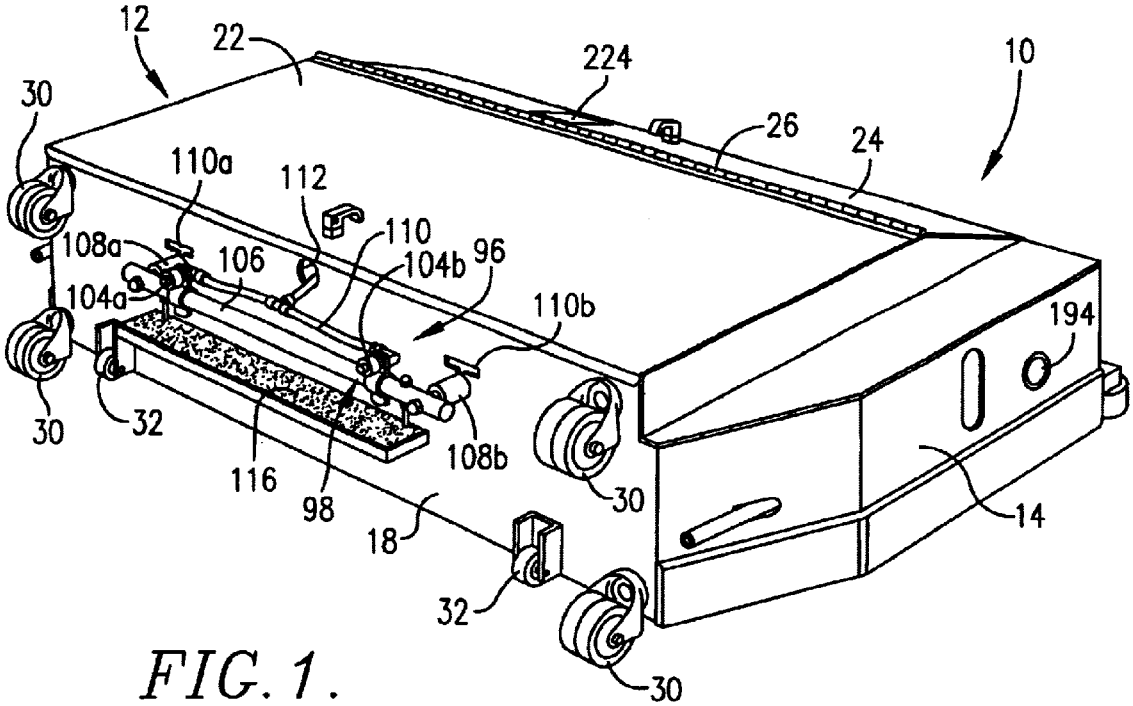
FIG. 1 is a left front perspective view of a lane cleaning machine incorporating the principles of the present invention and capable of carrying out our novel method.
Figure 2:
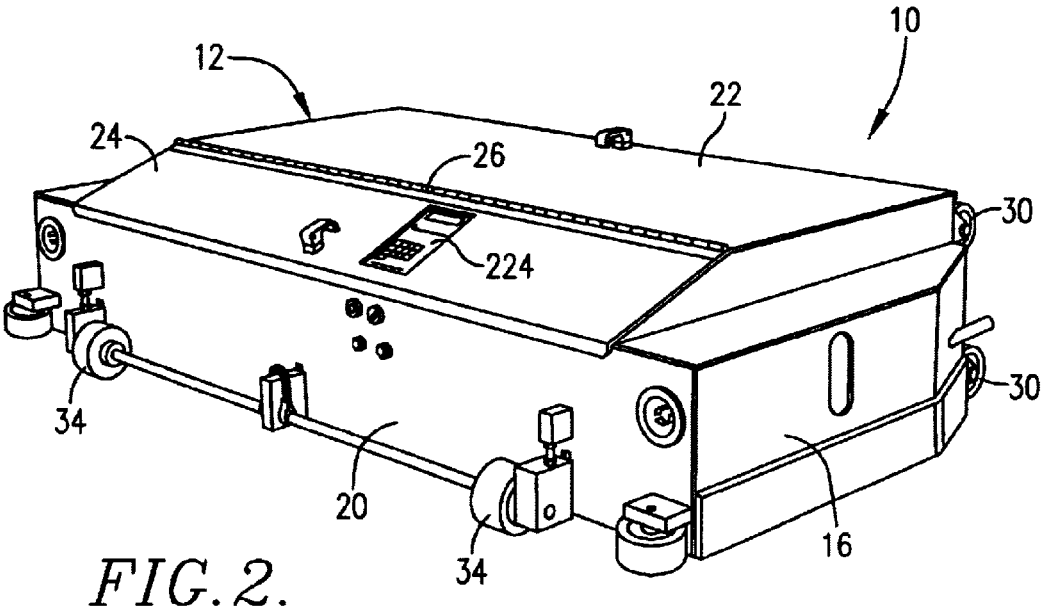
FIG. 2 is a right rear perspective view thereof.
Figure 4:
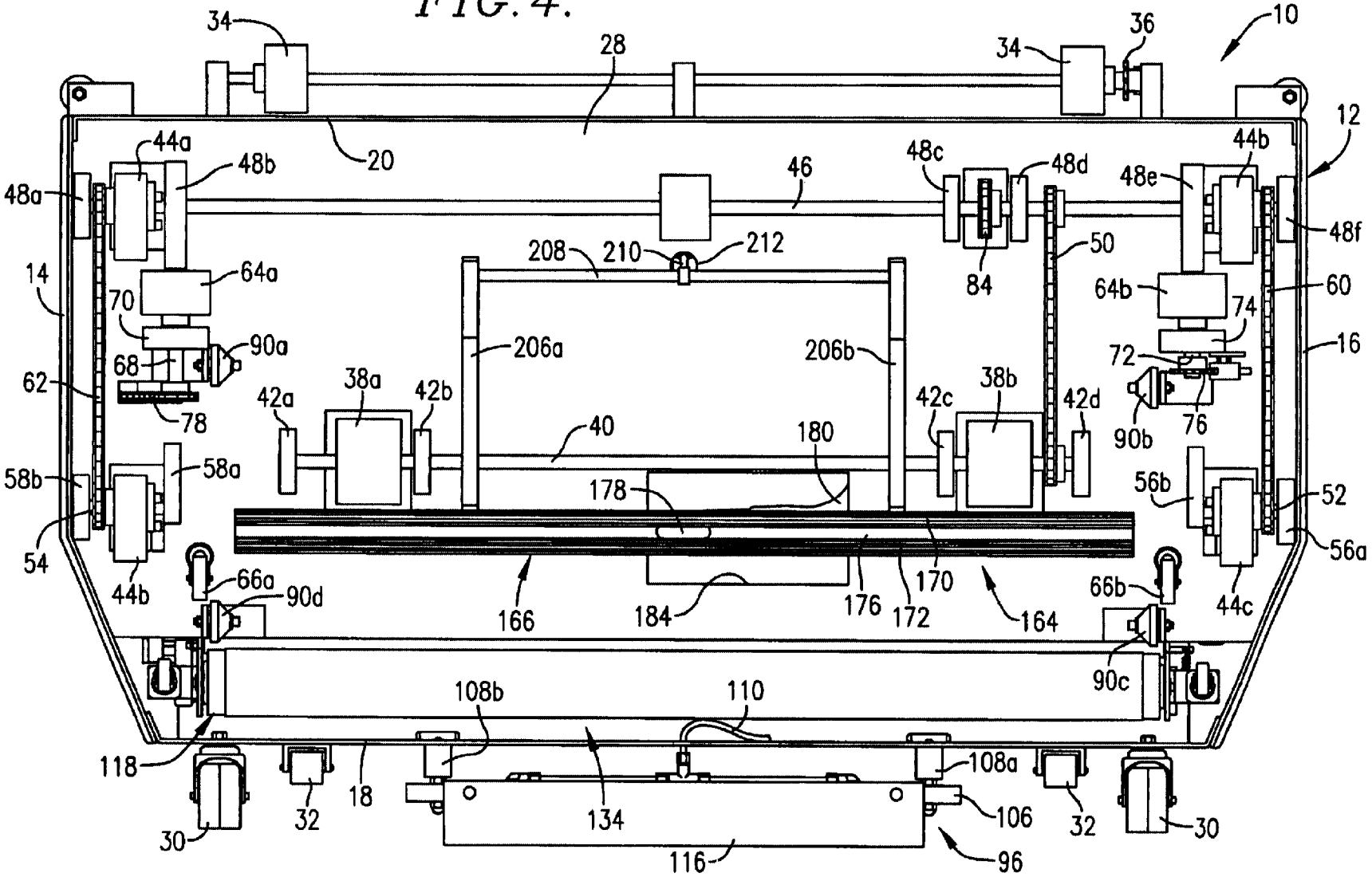
FIG. 4 is a bottom plan view of the machine.

As illustrated in the perspective view of FIGS. 1 and 2, the present invention may be incorporated into a lane maintenance machine broadly denoted by the numeral 10 that includes a housing 12 which contains major operating components of the machine. Housing 12 includes left and right sidewalls 14 and 16, respectively, a front wall 18 spanning the sidewalls 14,16 across the front of the machine, an upright rear wall 20 spanning the sidewalls 14,16 across the rear of the housing 12, and a top presented-by a pair of transversely hinged top lids 22 and 24. The transverse hinge 26 interconnects the lids 22,24 to permit independent, selective raising and lowering of such lids for access to the interior compartment of the machine. As shown in FIG. 4, the housing 12 also includes a flat bottom wall 28 which spans the sidewalls 14,16 and extends forwardly from the rear wall 20 to a point short of the front wall 18. The machine 10 selected for illustration is preferably an automatic machine capable of transporting itself along the lane surface from the foul line to the pin deck, and then back again, as well as climbing onto the approach area behind the foul line, indexing itself over to the next adjacent lane, and moving into position onto such next lane to repeat the cycle back and forth down the lane. Preferred automatic features are disclosed in the '725 application, which is hereby incorporated by reference into the present application for a full and complete understanding of the automatic, lane-to-lane indexing features of the machine 10 and its manner of movement back and forth along each lane. In order to provide a basic understanding of the means by which the machine 10 carries out its various operating movements, the propulsion and drive control system for the machine will now be described in general terms.

The front wall 18 carries four caster wheels 30 at the four corners of the front wall 18 for supporting the machine 10 when it is stood on end during storage and movement to and from the lane area. A pair of assist rollers 32 are also provided along the lower extremity of the front wall 18 to help the machine 10 as it moves from a position on the lane itself to the approach area behind the foul line, which involves causing parts of the machine to literally climb out of the gutters along the opposite side margins of the lane. On the opposite rear wall 20 of the machine, a pair of idler rolls 34 are mounted for free-wheeling engagement with the lane surface as the machine moves along the lane and one of the idler rolls 34 has a lane distance indicating sprocket 36 (FIGS. 3 and 4) associated therewith for use in controlling various operations of the machine in relation to the distance the machine is moved along the lane.

With reference initially to FIG. 4, it will be seen that a number of drive wheels are provided on the bottom of the machine 10 to carry out the various driving movements of the machine along the lane, onto and off of the approach, and sideways across the approach in an indexing movement. For movement back and forth along the lane itself, a pair of laterally spaced apart lane driving wheels 38*a* and 38*b* are provided on generally opposite ends of a long, transversely extending axle 40 supported beneath the bottom wall 28 by mounting brackets 42*a*, 42*b*, 42*c*, and 42*d*.

For moving the machine fore-and-aft in a transition mode, behind the foul line on the approach, the machine is provided with four eccentrically mounted transition wheels 44*a*, 44*b*, 44*c*, and 44*d* located generally adjacent the four corners of the bottom wall 28. The two transition wheels 44*a* and 44*b* are secured to opposite ends of a long, transverse axle 46 supported by depending mounting brackets 48*a*, 48*b*, 48*c*, 48*d*, 48*e*, and 48*f*. A fore-and-aft drive chain 50 operably interconnects the axle 46 of the transition wheels 44 with the axle 40 of the lane drive wheels 38 such that wheels 38 and 44 are all rotating simultaneously. The remaining transition wheels 44*c* and 44*d* have respective stub axles 52 and 54 supported by depending mounting brackets 56*a*, 56*b*, and 58*a*, 58*b*, respectively. A foreand-and-aft drive chain 60 along the sidewall 16 operably couples the axle 46 with the stub axle 52, while a similar fore-and-aft drive chain 62 along sidewall 14 operably couples the axle 46 with the stub axle 54 such that all four of the transition wheels 44 are rotated simultaneously, as well as the lane drive wheels 38.

It will be appreciated that inasmuch as the main drive wheels 38 are mounted concentrically on their axle 40, movement of the machine along the lane surface is smooth and flat. On the other hand, inasmuch as the transition wheels 44 are mounted eccentrically on their respective axle, such transition movement on the approach is akin to a slight hopping movement, as explained in detail in the incorporated application.

For indexing the machine from lane-to-lane, the machine is provided with a pair of transversely oriented indexing wheels 64*a* and 64*b* that are situated generally adjacent respective sidewalls 14 and 16 in transversely aligned relationship with one another. In addition, a pair of caster wheels 66*a* and 66*b* are located in forwardly spaced relation to the indexing wheels 64 in order to provide four-point support for the machine as it carries out its indexing movement. Only the indexing wheel 64*a* is driven, the remaining wheels 64*b*, 66*a*, and 66*b* all being free-wheeling and simply rotated by the surface of the approach as the indexing movement is carried out. The indexing wheel 64*a* is carried by a fore-and-aft extending stub axle 68 supported by mounting brackets 70 and the bracket 48*b*, while the other indexing wheel 64*b* is mounted on a stub axle 72 which is carried by a mounting bracket 74 and the bracket 48*e*. The axle 72 associated with the free-wheeling indexing wheel 64*b* carries a counting sprocket 76 at its forwardmost end, while the other axle 68 associated with the driven indexing wheel 64*a* has a driving connection with a drive chain 78 at its forwardmost end.

Figure 3:
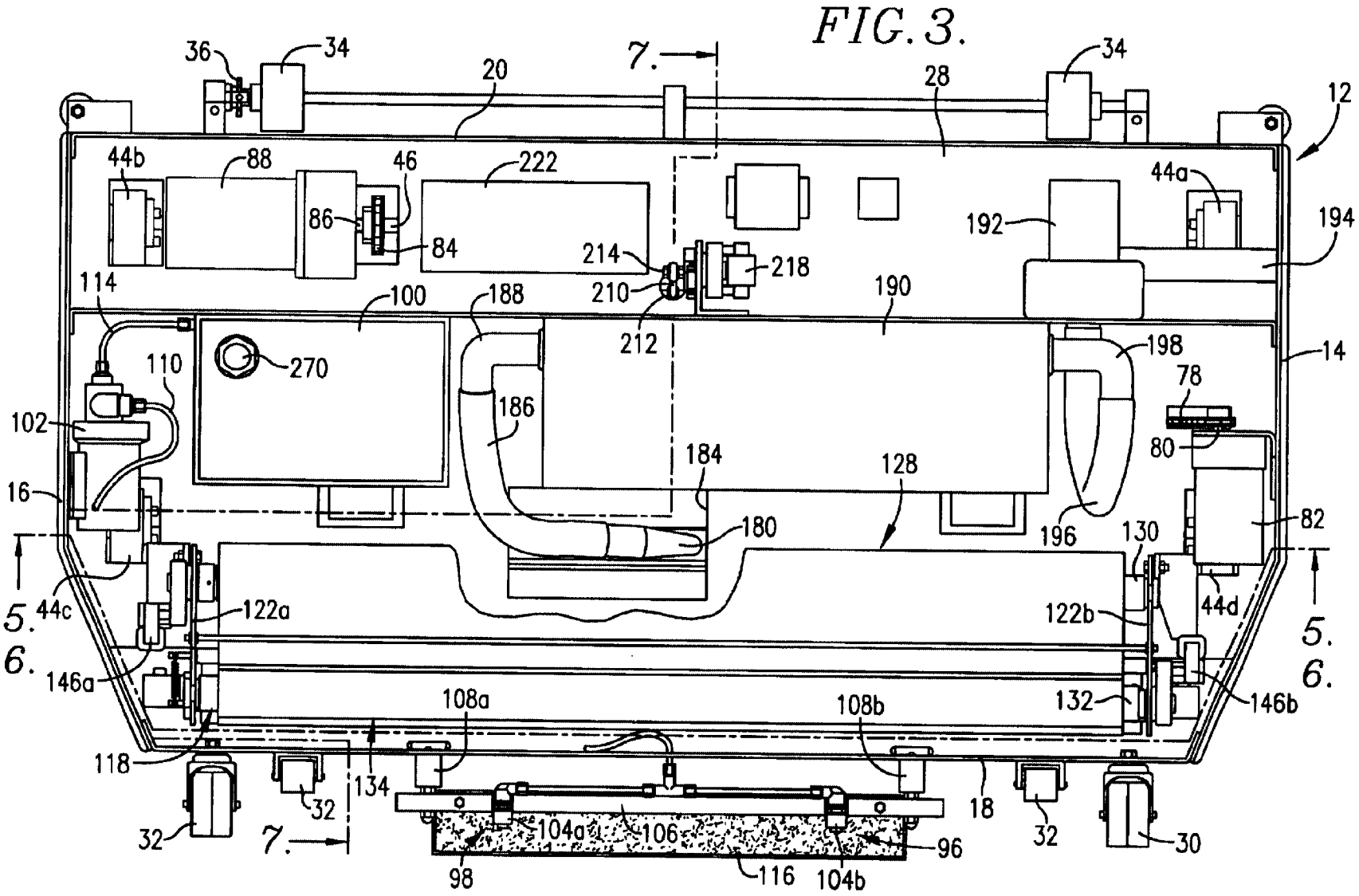
FIG. 3 is a top plan view of the machine with the cover removed to reveal interior details.

As illustrated in FIG. 3, the drive chain 78 associated with the indexing wheel 64*a* projects up through an opening in the bottom wall 28 of the housing and makes a driving connection with the output shaft 80 of a selectively operable drive motor 82. On the other hand, the drive axle 46 for the transition wheels 44 (and hence also for the lane drive wheels 38) has a drive chain 84 that leads upwardly from the axle 46 through an opening in the floor 28 to a driving connection with the output shaft 86 of a drive motor 88 mounted on the top surface of the bottom wall 28.

Figure 6:
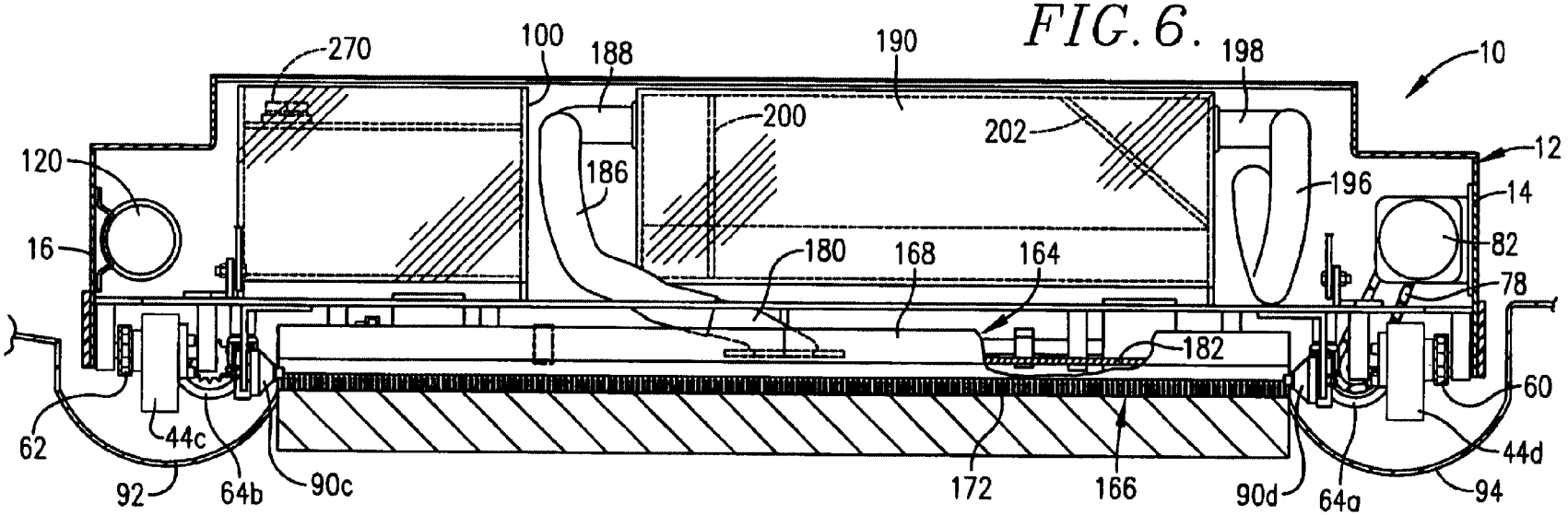
FIG. 6 is a transverse, vertical cross-sectional view of the machine similar to FIG. 5, but with the web assembly removed to reveal details of the squeegee mechanism and other structure.

Returning to FIG. 4, it will be seen that the bottom of the machine is also provided with four strategically placed, frusto-conical guide rollers 90*a*, 90*b*, 90*c*, and 90*d* that are positioned to embrace opposite sides of the lane as the machine is placed in use, and to thus maintain the machine properly located on the lane as it moves back and forth. As illustrated in FIG. 6, the guide rollers 90 hang over into the lane gutters 92 and 94 when the machine is on the lane itself, as do the transition wheels 44 and the indexing wheels 64. The lane drive wheels 38, however, are more closely spaced apart and are thus in position to bear against the lane surface and move the machine up and down the lane at this time.

Figure 5:
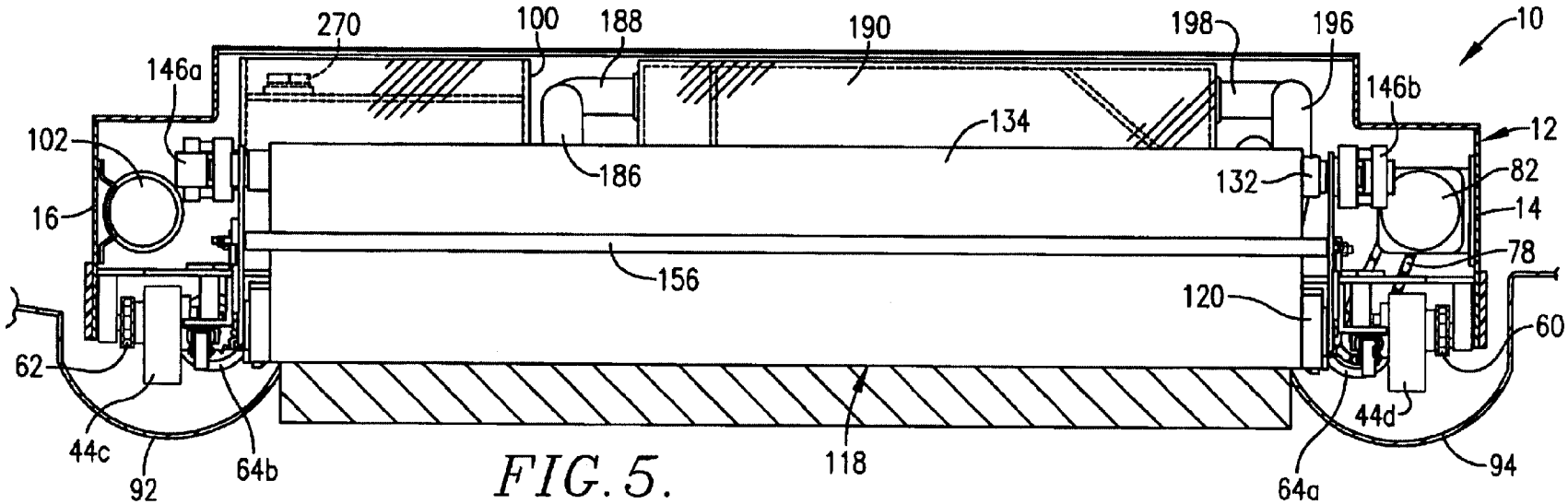
FIG. 5 is a transverse, vertical cross-sectional view of the machine taken.substantially along line 5—5 of FIG. 3.

In accordance with the present invention, the machine 10 is provided with applicator mechanism broadly denoted by the numeral 96 for use in applying a cleaning liquid to the lane surface as the machine moves down the lane from the foul line toward the pin deck area. Broadly speaking, the applicator mechanism 96 includes a nozzle assembly 98 situated on the front wall 18 of the housing, a liquid supply reservoir 100 (FIGS. 3, 5, and 6) within the housing 12 on the top side of the bottom wall 28, and a pump assembly 102 adjacent the reservoir 100 for intermittently supplying the cleaning agent to the nozzle assembly 98. As will be appreciated from the description which follows later, the applicator mechanism 96 also includes a variety of controls for regulating the spraying action of the nozzle assembly 98.

The nozzle assembly 98 in the illustrated embodiment includes a pair of forwardly projecting nozzles 104*a* and 104*b* carried by a frame 106 that is removably secured to the front wall 18 so as to permit the nozzle assembly 98 to be detached from the housing 12 during periods of non-use and when the machine is to be placed on end and wheeled from location to location using the front caster wheels 30. To achieve such removability, the frame 106 includes a pair of fore-and-aft extending, generally T-shaped brackets 108*a* and 108*b* at its opposite lateral ends which removably fit into corresponding T-shaped slots 110*a* and 110*b* (FIG. 1) in the front wall 18. A supply line 110 connected to the nozzles 104 passes through a clearance hole 112 (FIG. 1) in the front wall 18 and leads to the supply pump 102, which in turn has a line 114 communicating the same with the reservoir 100. A drip tray 116 supported by the frame 106 beneath the nozzles 104 is in position for catching drips which may emanate from the nozzles 104 between actuating cycles thereof. It will be appreciated that the number of nozzles 104 selected for use is a matter of choice and that only a single nozzle 104, or more than two nozzles 104, might be selected for use. In preferred forms of the invention the spray from nozzles 104 isn "on" for durations ranging from one-half to one second each, while they are "off" for durations of one to two and one-half seconds each.

Figure 9:
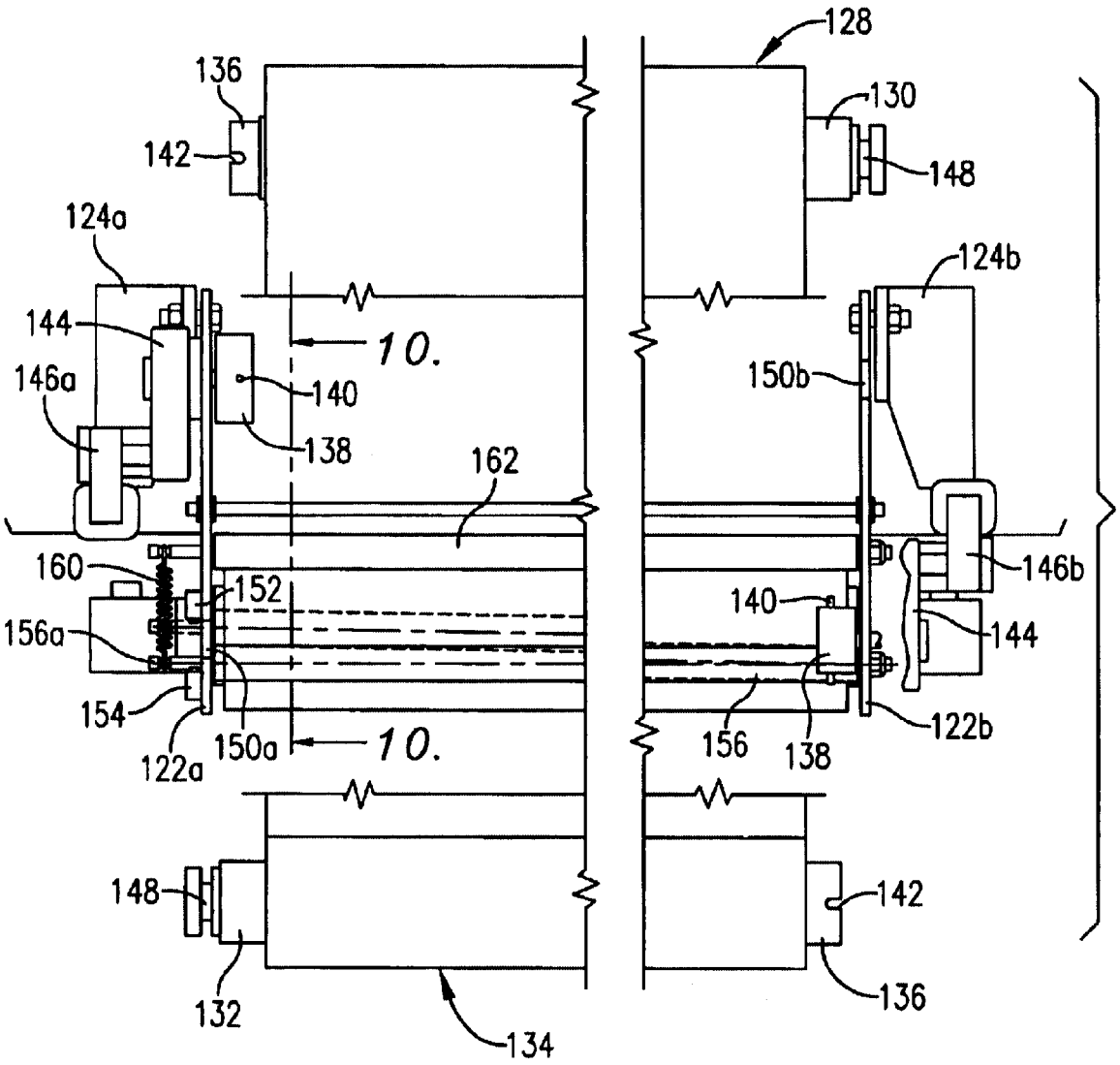
FIG. 9 is a schematic, top plan view of the web assembly illustrating details of construction of the web payout and takeup portions of the assembly.
Figure 10:
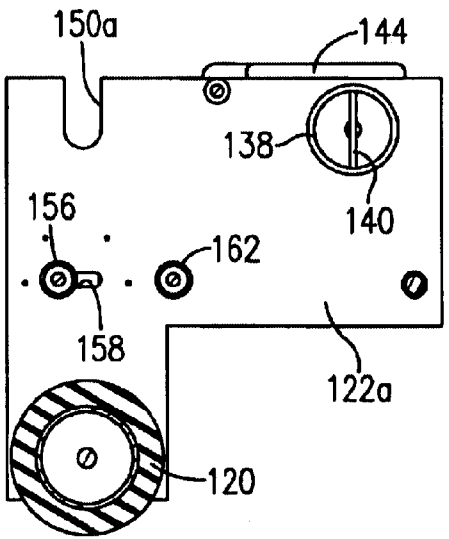
FIG. 10 is an enlarged, vertical cross-sectional view taken substantially along 10—10 of FIG. 9.

Behind the applicator mechanism 96 and within the front portion of the housing 12 is a wiper web assembly broadly denoted by the numeral 118, the main function of which is to meter, spread and distribute the liquid which has been applied to the lane surface into a relatively thin, even film which can be more completely and readily picked up and removed from the lane surface by other structure within the machine. Broadly speaking, as illustrated perhaps best in FIGS. 11–14, the web assembly 118 includes a backup cushion roller 120 supported transversely within the machine and having its lower arcuate periphery projecting through a clearance gap in the bottom of the housing defined between the front extremity of the bottom wall 28 and the front wall 18. As illustrated in FIGS. 9 and 10, the cushion roller 120 is supported between a pair of opposite end plates 122*a* and 122*b*. The end plates 122 are, in turn, fixed to the bottom wall 28 via generally L-shaped brackets 124*a* and 124*b*, respectively. The cushion roller 120 is adapted to free-wheel in either rotative direction about an axis transverse to the path of travel of the machine 10, although as will be pointed out hereinafter, there is only a slight amount of rotation of the roller 122 that occurs during operation of the machine, i.e., during the time that the wiping web of the assembly 118 is being adjusted to pay out additional fresh material.

In addition to the cushion roller 120, the web assembly 118 also includes a wide, soft, web of absorbent material 126 that is looped beneath the roller 120 such that the surface of the web 126 is disposed for engagement with the lane surface instead of the exterior of the cushion roller 120. The web 126 comes from a supply roller 128 of the material carried on a roller 130 that spans the opposite end plates 122 at the upper rear extremity thereof. On the other hand, the web 126 leads from the cushion roller 120 up to a takeup roller 132 which spans the end plates 122 adjacent the upper front corner thereof. Thus, the takeup roller 132 is used for storing a roll 134 of used or spent portions of the wiping web 126.

Each of the rollers 130,132 is configured at its opposite ends for ease of removal and replacement from the end plates 122, and for operable connection with a source of periodic driving power in this respect, as illustrated particularly in FIGS. 9 and 10, it will be seen that each roller 130,132 has a drive end cap 136 that fits into abmating, cylindrical drive socket 138 on the corresponding end plate 122. Each drive socket 138 includes a cross bar 140 that traverses the socket so as to slip matingly into a corresponding cross notch 142 in the end cap 136 of the respective roller 130 or 132. The drive socket 138 is, in turn, drivingly coupled through a gear box 144 with a corresponding drive motor 146*a* or 146*b*, the motor 146*a* being used to operate the supply roller 130 while the motor 146*b* is used to drive the slack takeup roller 132.

The opposite end of each roller 130,132 is configured to present a reduced diameter shank portion 148 that slips removably into a corresponding upright notch 150*a* or 150*b* in the upper edge of the corresponding end plate 122*a* or 122*b*. The notches 150 are capable of rotatably retaining the proximal ends of the rollers 130,132 by gravity, yet permit such ends to be raised up out of the plates 122 so as to thereupon withdraw the end caps 136 from the drive sockets 138 during removal and replacement of the supply roll 128 and the takeup roll 134.

Figure 7:
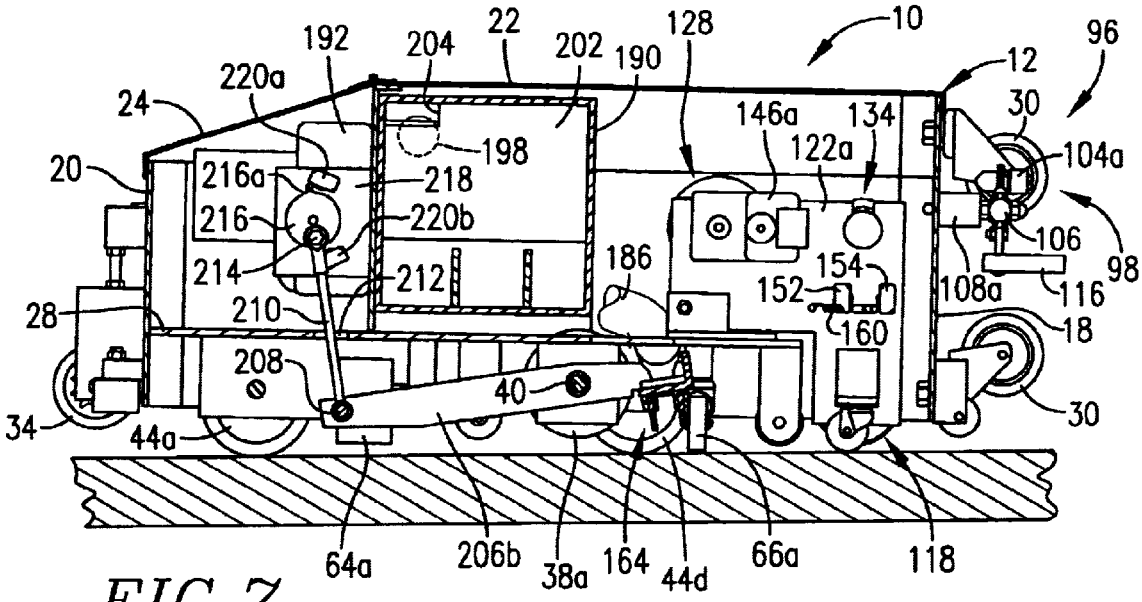
FIG. 7 is a fore-and-aft vertical cross-sectional view taken substantially along 7—7 of FIG. 3 while the machine is on the approach area with the squeegee raised to an inoperative position.
Figure 8:
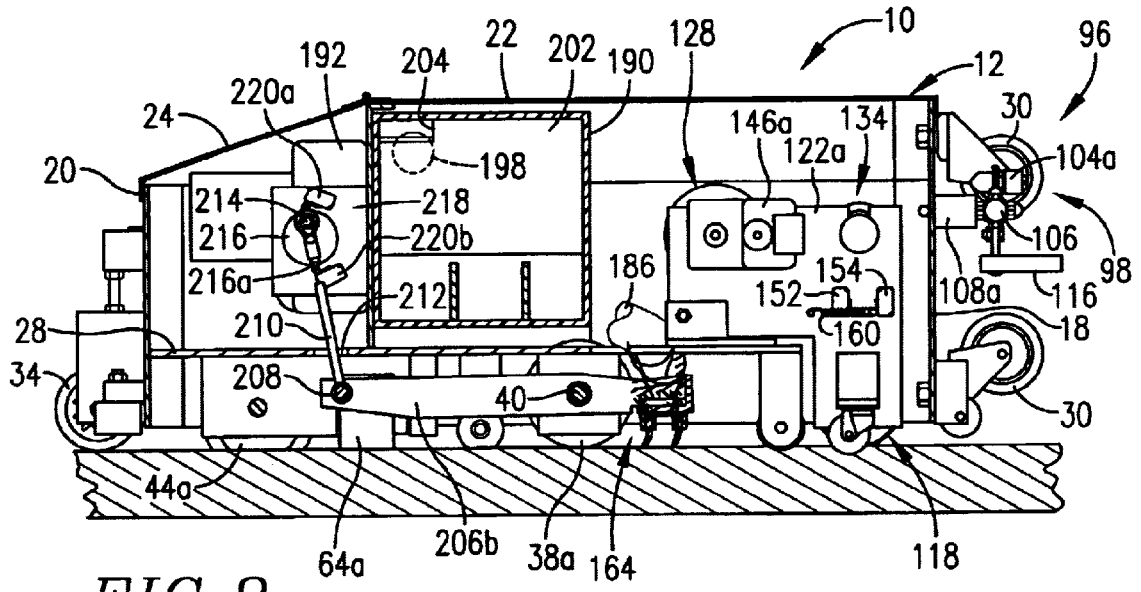
FIG. 8 is a vertical cross-sectional view similar to FIG. 7, but illustrating the machine on the lane itself with the squeegee lowered into its operative position and other components of the machine in their operating positions.
Figure 15:
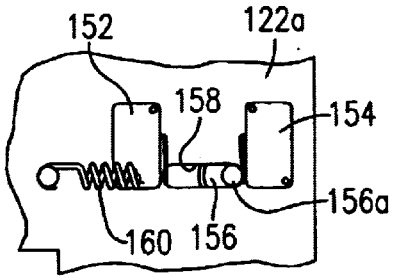
FIGS. 15 and 16 are fragmentary detail views of the switch actuating means for the pay out cycle of the web.
Figure 16:
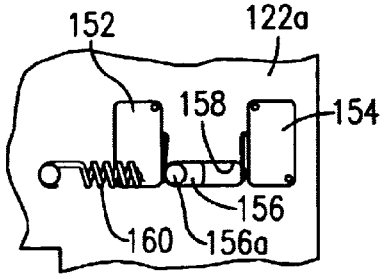

Operation of the motors 146*a* and 146*b* is controlled in part by a pair of limit switches 152 and 154 illustrated in detail in FIGS. 15 and 16, but also shown more broadly in FIGS. 7, 8, and 9. The switches 152 and 154 are mounted on the right end plate 122*a* on the outside surface thereof in fore-and-aft, mutually spaced relationship. The outermost end 156*a* of a transversely extending tensioning rod 156 is located within the space between the two limit switches 152,154 and is movable back and forth between alternate actuating positions thereof, as illustrated in FIGS. 15 and 16, due to the presence of a horizontal clearance slot 158 in the right end plate 122*a*. The main body of the tensioning rod 156 projects on across the distance between the two end plates 122 on the forward side of the front span 126*a* of the web 126 leading upwardly from the cushion roller 120 to the takeup roll 134. The far end of the tensioning rod 156 at the end plate 122*b* is loosely fixed to the plate 122*b* at that location and does not move in a fore-and-aft slot. However, the connection at that point is such as to allow the rod 156 to swing fore-and-aft in a limited amount of movement, as illustrated in FIG. 9, such that the outermost end 156*a* thereof can move between its opposite, alternate switch actuating positions of FIGS. 15 and 16.

Figures 11, 12, 13, 14, 17:
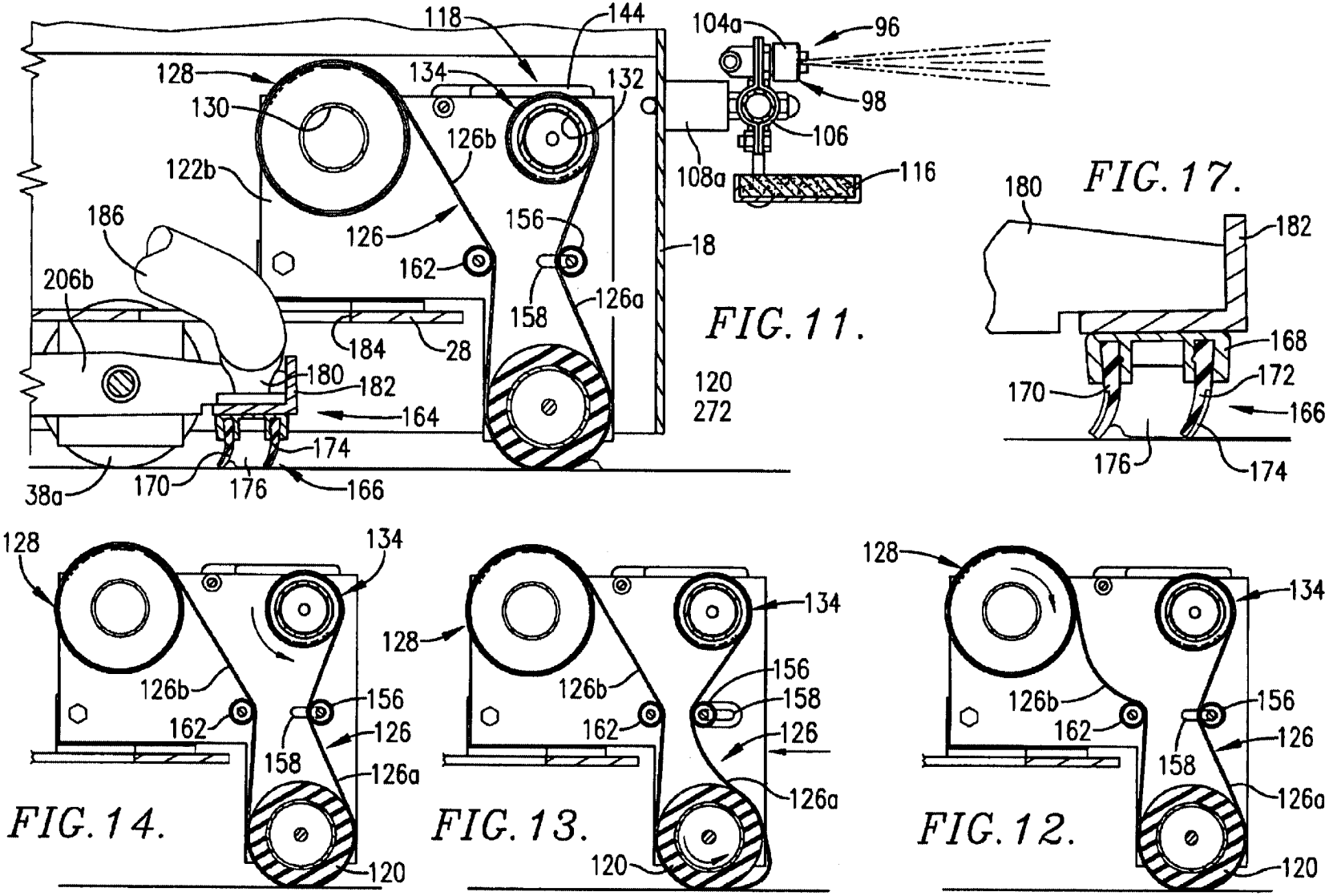
FIG. 11 is a fragmentary, fore-and-aft, vertical cross-sectional view through the machine illustrating the manner of operation thereof.
FIGS. 12, 13, and 14 are sequential, schematic illustrations of the web assembly illustrating steps in the payout of a new section of fresh web material to the wiper roll and the takeup of used portions thereof.
FIG. 17 is an enlarged, fragmentary detail view illustrating the squeegee action as the film of liquid and grimy material are skimmed from the lane surface and directed into the vacuum head during operation of the machine.

A tension spring 160 on the outside of the right end plate 122*a* yieldably biases the tensioning rod 156 toward the switch actuating position of FIG. 16 in which the outer end 156*a* of the tensioning rod 156 is at the rear of the slot 158. The rod will be in this rearmost position actuating the switch 152 when there is slack in the front span 126*a* of the web 26 as illustrated, for example, in FIG. 13. At other times, the rod 156 will be located at the forward end of the slot 158 actuating the front switch 154 due to the tension in the front web span 126*a* which is adequate to overcome the force of the spring, as illustrated, for example, in FIGS. 11, 12, and 14. A second transverse tension rod 162 spans the end plates 122 behind the rear span 126*b* of the web 126 and maintains tension on such rear span 126*b* at all times in the operation of the machine, except when additional fresh web length is being paid out, as illustrated in FIG. 12. The tension rod 162 is not movable fore-and-aft like the partially swingable tension rod 156.

Preferably, the web of material 126 comprises a non-woven, compressed rayon acrylic material, although other types of soft, absorbent material may be satisfactory. One suitable such material is manufactured by Erikson Non-Woven Textiles, Inc., of Janesville, Wisconsin, and is available from DBA Corporation, of Chicago, Illinois, under the trade designation "Linoduster" cloth.

The cleaning machine 10 also includes a pickup assembly broadly denoted by the numeral 164 for use in completely removing from the lane surface the thin film of cleaning liquid and other extraneous materials left on the lane after the wiper assembly 118 has passed over such area. The pickup assembly 164 includes as one of its primary components a squeegee unit 166 which preferably comprises a generally transversely U-shaped holder 168 having a pair of depending, resilient skimming blades 170 and 172 affixed thereto in fore-and-aft spaced relationship. The squeegee unit 166 extends across the full width of the lane and is disposed for forcible wiping engagement with the lane surface during peration such that the two skimming blades 170,172 are flexed slightly to the rear, as particularly illustrated in FIGS. 11 and 17.

Preferably, the squeegee unit 166 is of the type readily commercially available and frequently utilized in connection with floor scrubbing equipment. Those skilled in the art are well familiar with sources of supply for such units.

The front and rear squeegee blades 170,172 are both provided with a series of upright grooves 174 therein, although such grooves 174 are actually only necessary in the front blade 172. In the commercial form, however, such grooves 174 are provided in the front surface of the front blade 172 and the rear surface of the rear blade 170 such that the squeegee unit 166 is symmetrical. The purpose of such grooves 174 is to present periodic channel-like passages in the front blade 172 when the latter is flexed during engagement with the underlying surface such as shown in FIG. 17, such passages thus communicating the front side of the squeegee unit 166 with a chamber 176 formed between the two blades 170,172. Liquid in front of the front squeegee blade 172 may thus pass into the chamber 176 by converging toward a proximal groove 174 and entering into the chamber 176 in the form of a narrow bead or stream. However, due to the fact that the grooves 174 on the rear blade 170 face to the rear, the flexing as illustrated in FIG. 17 does not present flow passages to the liquid within the chamber 176 such that liquid passing rearwardly into chamber 176 is trapped there by the rear blade 170 and not-permitted to escape past that point.

The squeegee unit 166 is designed to form part of a vacuum pickup head having an inlet presented by an inlet opening 178 in the top wall of the holder 168 at the center thereof, as illustrated in FIG. 4. The inlet opening 178 in turn communicates with an intake head 180 secured to a generally transversely L-shaped backing bar 182 that carries the squeegee unit 166. The backing bar 182 is provided with an opening (not shown) that allows the communication between the inlet opening 178 of the squeegee unit 166 and the intake head 180.

The bottom wall 28 of the housing 12 has a rectangular opening 184 directly above the intake head 180 and through which a vacuum suction hose 186 leads from the intake head 180. At its opposite end above the bottom wall 28 the suction hose 186 is connected to an elbow fitting 188 leading into the upper rear corner of a holding tank 190 for liquid picked up by the pickup assembly 164. Vacuum pressure to the hose 186 and the inlet opening 178 at the squeegee unit 166 is provided by a fan 192 mounted on the top side of the bottom wall 28 near the left rear corner of the machine, the fan 192 having a transverse exhaust pipe 194 to the atmosphere and an intake air line 196 that connects the fan 192 with an outlet elbow fitting 198 in the upper left rear corner of the holding tank 190.

As illustrated in FIG. 6, the holding tank 190 is provided with a pair of baffles 200 and 202 which, among other things, operate to cause the liquid sucked into the tank 190 to drop by gravity at that location rather than pass completely through the tank and out of the machine through the fan 192. The baffle 200 is vertically disposed adjacent the right end of the holding tank 190 (as viewed from the rear of the machine looking forward) and extends from top to bottom of the tank 190 and front to rear thereof, except for a small cutout portion in the lower front corner of the tank which permits the liquid entering the tank via the elbow 188 to impact the baffle 200 and then gravitate downwardly toward the bottom of the tank and communicate with the remainder of the interior space thereof via the cutout portion (not shown). However, the air can continue on through the baffle 200 via a similar small cutout portion (not shown) in the upper rear corner of the baffle 200.

The other baffle 202 is inclined upwardly and inwardly and spans the tank 190 completely from front to rear, although it does not extend completely to the bottom of the tank FIGS. 7 and 8 show that the inclined baffle 202 has a rectangular port 204 in its upper rear corner that is aligned with the similar, non-illustrated port in the upper rear corner of the upright baffle 200, and which is also generally aligned with the elbow fitting 198, as illustrated in phantom in FIGS. 7 and 8. It will thus be seen that although the air can flow completely through the holding tank 190, once the liquid drops out of the airstream, it is trapped within the lower regions of the tank 190 and does not reach the outlet provided by the elbow 198, even when the machine may be upended to place the caster wheels 30 on the ground in order to wheel the machine between its storage site and its operating site.

As illustrated in FIGS. 7 and 8, the pickup assembly 164 is designed to be raised and lowered between operative and inoperative positions. In this regard, the intake head 180, backup member 182 and squeegee unit 166 are mounted as a unit on a pair of rocker arms 206*a* and 206*b* (see also FIG. 4) that are pivotal about the axle 40 of the lane drive wheels 38. A transverse tie rod 208 interconnects the rocker arms 206 at their rear ends and has an upright operating link 210 that passes up through a hole 212 in the bottom wall 28 and connects with an eccentric connector 214 on the rotatable output driving disk 216 of a motor 218. When the motor 218 drives the disk 216 through 1800 of travel, the operating link 210 rocks the arms 206 upwardly or downwardly, as the case may be, to raise or lower the pickup assembly 164 between its two extreme positions of FIGS. 7 and 8. A pair of diametrically opposed limit switches 220*a* and 220*b* on the motor 218 are alternately operated by a lobe 216*a* on the disk 216 to assist in controlling the operating cycles of the operating link 210.

Figure 18:
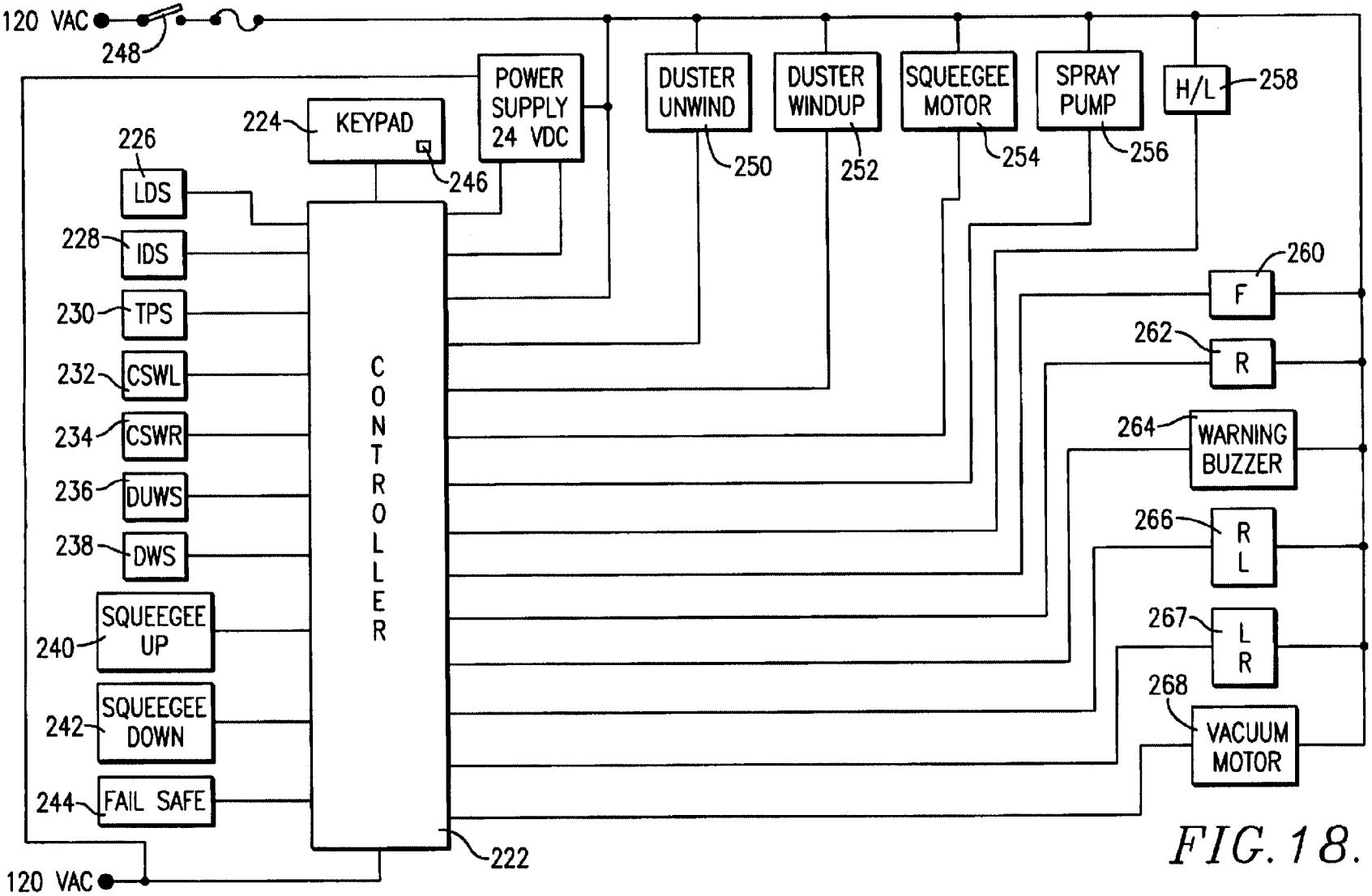
FIG. 18 is a schematic diagram of the control system for the machine.

The various functions of the machine 10 are controlled by a control system shown schematically in FIG. 18, a primary component of which control system comprises a controller 222 (OMRON SYSMAC Programmable Controller Model C 28H). A data entry keypad 224 connected with the controller 222 is readily accessible to the user on the rear lid 24 of the housing 12, as shown in FIGS. 1 and 2. The control system operates on conventional 120 VAC power and, in addition to the controller 222 and the keypad 224, also includes lane distance sensor 226 (LDS), indexing lane sensor 228 (IDS), transition wheel position sensor 230 (TWPS), left cord switch 232 (CSWL), right cord switch 234 (CSWL), duster unwind switch 236 (DUWS), duster wind switch 238 (DWS), squeegee up switch 240 (SUS), squeegee down switch 242 (SDS), failsafe switch 244, start switch 246 (the lower right button of keypad 224), and power switch 248.

Outputs from the controller 222 in response to inputs from the sensors and switches 226–246 include a duster unwind drive motor relay 250, a duster windup motor relay 252, a squeegee motor relay 254, a sprayer pump motor relay 256, high/low speed drive motor relay 258, forward drive motor relay 260, reverse drive motor relay 262, warning buzzer relay 264, move to left indexing motor relay 266, a left-to-right relay 267 for indexing the machine from left-to-right on the approach if desired and vacuum motor relay 268.

The conventional data entry keypad 224 allows an operator of the machine 10 to enter which of the lanes the machine will start and stop on for any maintenance cleaning operation, and also allows changes in data entered when the machine was initialized. Furthermore, it allows the operator to program the machine for either a full lane cleanup or only a partial lane cleanup as may be desired. Generally speaking, the controller 222 operates according to the computer program flow chart illustrated in FIGS. 19A, 19B, and 19C and discussed further below.

The lane distance sensor 226 (SUNX PMT53) is an infrared sensor connected to the rear wall 20 adjacent the indicator sprocket 36. As the machine 20 moves longitudinally, the lane support rollers 34 rotate, as does the indicating sprocket 36. As each tooth of sprocket 36 interrupts the infrared beam, the sensor 226 provides an input count to the controller 222. Such counts are used to determine the distance of travel of the machine along the lane.

Likewise, the indexing distance sensor 228 is. also an infrared pulse counter (SUNX PMT53). The indexing distance sprocket 76 has teeth which interrupt the infrared beam from the indexing distance sensor 228 such that, as the machine 20 moves sideways in the approach area of the bowling lane, the count pulses provided by the sensor 228 to the controller 222 provide a measurement of the lateral distance travelled.

The transition wheel sensor 230 is also an infrared sensor. The infrared beam of this sensor is interrupted by a projection (not shown) when the transition wheels 44 are in their up positions due to their eccentric mounting arrangements. With all four of the transition wheels 44 in their up positions, the result is that the machine 10 is supported totally by the, indexing wheels 64,66 in the approach area, or by the lane drive wheels 38 and support wheels 34 when on a lane.

Cord switches 232 and 234 function to stop operation of the machine 10 if the power input cord (not shown) is strained during lane movement). Relays 250–256, 264 and 268 include contacts conventionally wired to respective drive motors (or in the case of the buzzer 264, directly to the buzzer mechanism) to accomplish the various unwind, windup, lift, spray, and vacuum functions of the machine. Relays 258,260,262 and 267 include contacts conventionally wired to the main drive motor 88 to control the speed and direction thereof. Additionally, the left and right indexing relay 266 controls the direction of rotation of the indexing motor 82 in order to shift the machine 10 left or right during lane-to-lane indexing movement in the approach area.

OPERATION

The machine 10, and specifically the controller 222, is initialized in accordance with the number of bowling lanes in the users bowling center, the centerline spacing between such lanes, the approach area distance available behind the foul line of each lane, and the length of the bowling lane to be cleaned. Before starting, the operator should make certain that the reservoir 100 is full, and if not, should remove the fill cap 270 (FIGS. 3, 5, and 6) and fill the reservoir 100 with cleaning liquid. Although a variety of cleaning agents are well known to those skilled in this art, it is suggested that a water-based detergent available from DBA Corporation under its order no. 7592 is acceptable for the lane cleaning operations contemplated by the present invention.

In general terms, it will be noted that the machine 10 of the present invention is designed to move down the full length of a lane beginning generally with the foul line, to the pin deck area, and then back to the foul line. By virtue of the automatic indexing controls associated with the machine and disclosed also in the incorporated application Ser. No. 07/713,725, the machine 10 has the ability to move off the lane surface and onto the approach area, followed by an automatic indexing movement in a lateral direction over to the next lane, whereupon the cycle is repeated. It will be appreciated, however, that the lane cleaning features of the present invention are not necessarily limited to use in an automatic, lane-to-lane indexing machine. Although they are conveniently suited for such a machine and are also useable in a machine which merely travels up and down the lane, but then stops for manual movement to the next lane, it will be seen that many of the inventive concepts disclosed herein could be employed or embodied in a machine which is manually operated in many respects.

Broadly speaking, as the machine 10 moves along the lane as illustrated, for example, in FIG. 11, spray is emitted from the nozzles 104 to become deposited on the lane surface and to interact with the oil and grimy dirt located on such surface. While in prior machines this collected liquid has been immediately picked up by a suitable squeegee pickup or the like, in the present invention the wetted lane surface is instead immediately acted upon by the wiper web assembly 118 so as to spread out the liquid evenly and meter it in such a way that only a thin film is allowed to pass beneath the web 126 and cushion roller 120 to the pickup assembly 164. This thin film is then engaged by the front skimming blade 172 of the pickup assembly 164, is channelized into a series of minute streams aligned with the passage slots 174 (FIG. 17), and allowed to pass behind the skimming blade 172 and into the vacuum chamber 176 between the two blades 170,172. In that location, the liquid film is skimmed off the lane surface by the rear blade 170 and is directed centrally and upwardly into the suction head 180 for conveyance to the holding tank 190.

It will be appreciated that in its preferred form, the invention contemplates actuation of the nozzles 104 only intermittently, rather than on a continuous basis as the machine moves along the lane. Generally speaking, the frequency and duration of such actuation is such as to cause the wiping web 126 to push along a small bead 272 of the liquid ahead of itself during operation such that there is always sufficient liquid to pass beneath the cushion roller 120 to present the film back to the pickup assembly 164. On the other hand, there is no need to have a large pool of liquid in front of the cushion roll 120.

It will be further noted that the absorbent web 126 serves not only a metering function for the liquid which passes beneath it, but also a limited pickup function due to its inherent absorbent character. Thus, after one full movement down a lane surface, it is contemplated that the storage or supply roll 128 of the web material will be advanced sufficiently as to present a new lane-engaging portion to the cushion roll 120, while the used, saturated and somewhat dirty portion previously in engagement with the lane will be wound up on the take up roller 134. As illustrated in FIG. 12, the first step in this sequence is for the storage roll 128 to pay out a small amount of slack in the span 126*b* in the illustrated manner. Thereupon, as the machine 10 moves in a reverse direction back toward the foul line, the engagement between the cushion roll/web combination and the lane surface causes the cushion roll 120 to rotate counterclockwise through a small amount of angular movement sufficient to take up the slack which has been paid out by the roll 128. The used portion of the web 126 thus becomes disposed on the front side of the cushion roll 120 in the manner illustrated in FIG. 13, causing the span 126*a* to go slack.

The control spring 160 is thereupon permitted to swing the projecting end 156*a* of the-rod 156 rearwardly within the slot 156 in the manner illustrated in FIG. 13, causing the windup switch 152 (FIGS. 15 and 16) to be actuated for the takeup roll 134. Hence, takeup roll 134 rotates in a counterclockwise direction, as illustrated in FIG. 14, causing the tightening span 126*a* to shift the rod top 156*a* back toward the front of the machine until the switch 154 is actuated as in the FIG. 15 illustration, which turns off the takeup roll 134. It may or may not be desirable to advance the web 126 through more than one of such web payout and takeup cycles.

Once the machine returns to the approach area, the squeegee lift motor 218 may be actuated to raise the squeegee unit 166 to its inoperative position, as illustrated in FIG. 7, for carrying out the transition and lane indexing functions of the machine without the squeegee down in its operating position. Once the machine is then ready to repeat the operation on the next lane, the motor 218 is actuated again to lower the assembly of FIG. 8.

Figure 19B:
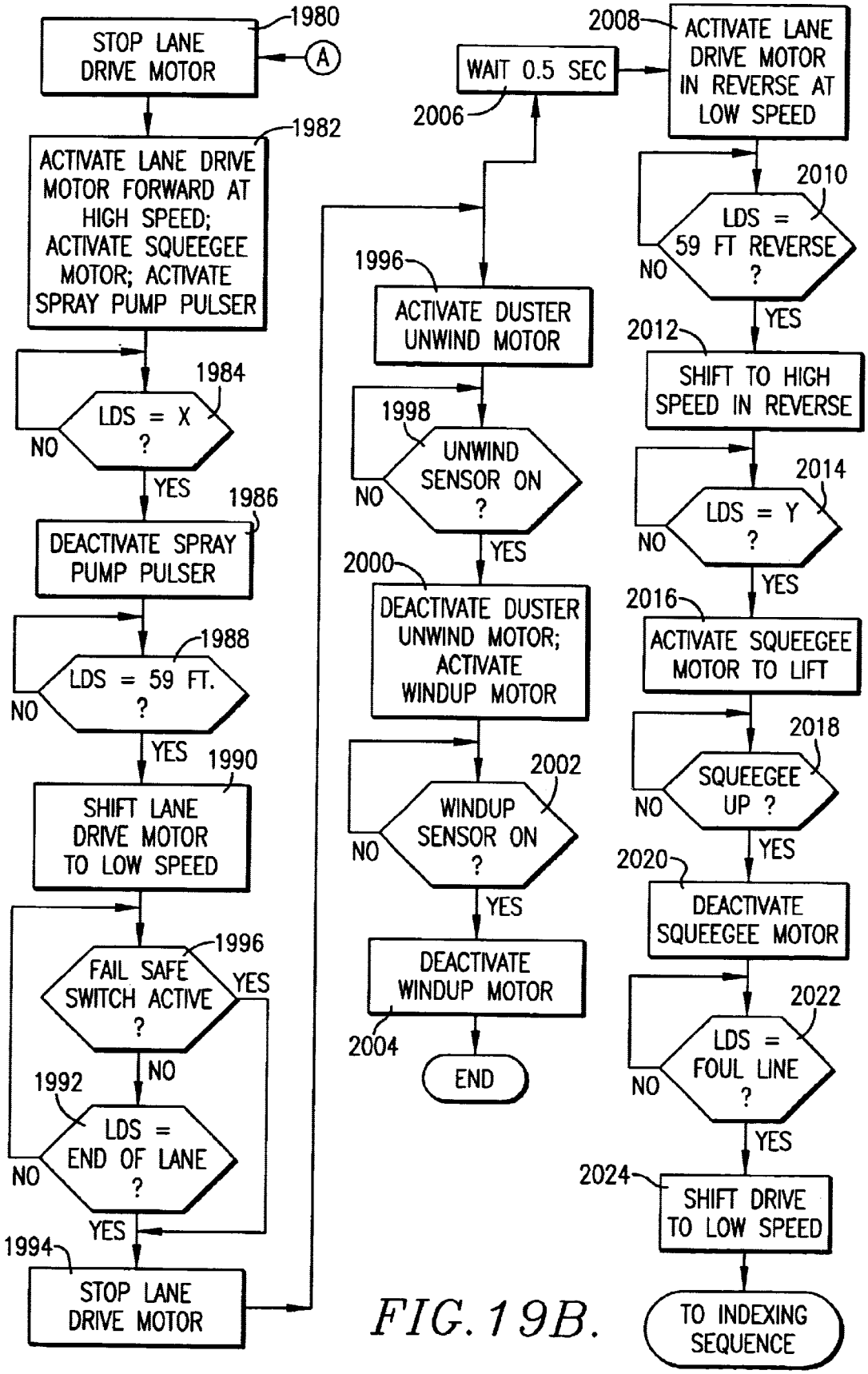
Figure 19C:
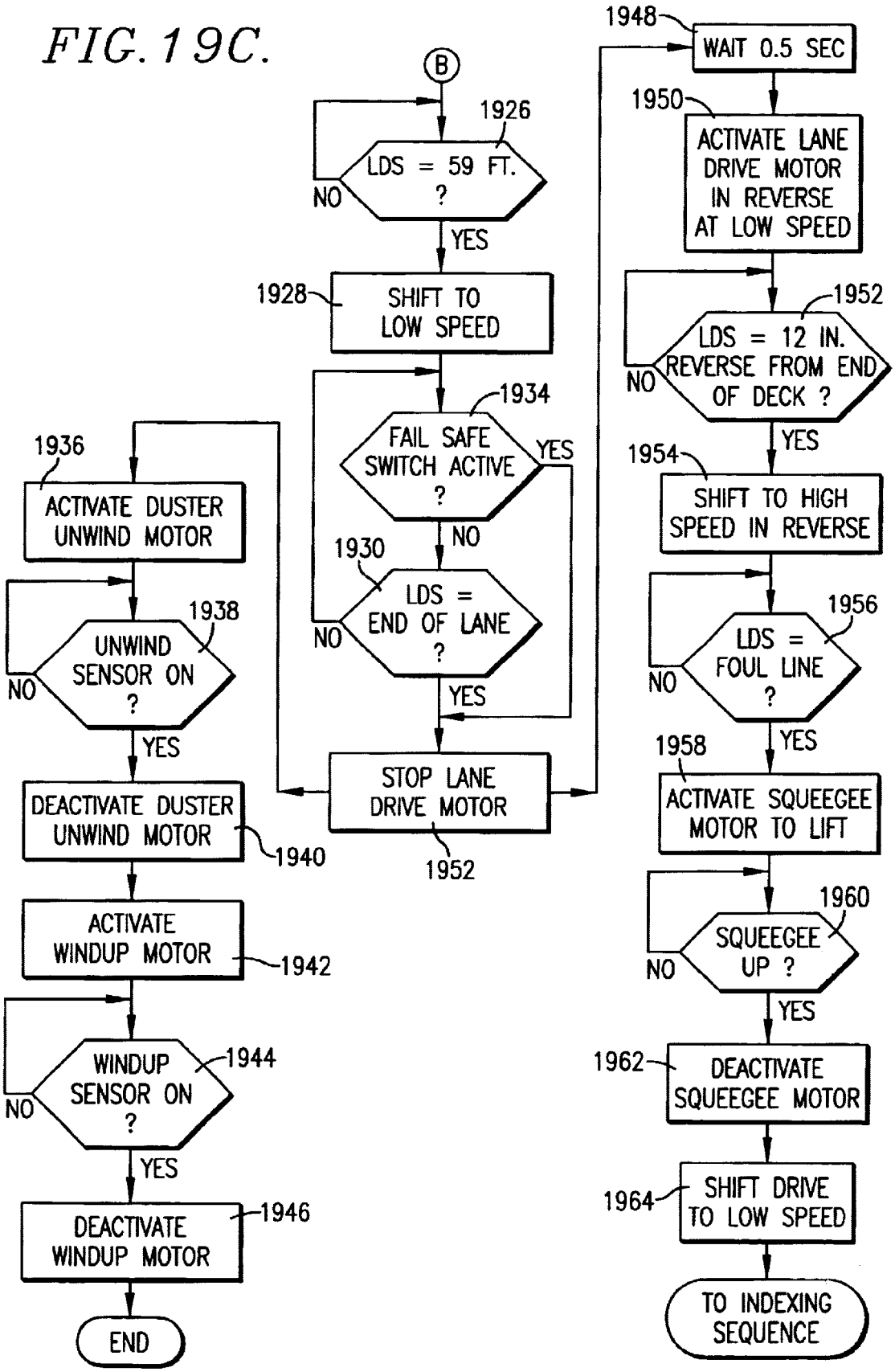

Referring now to the flow charges in FIGS. 19A, 19B, and 19C, activation of the start switch 246 by the operator is determined at step 1902. When the start switch is active, the answer in this step is "yes", and the program moves to step 1904, which causes the drive motor 88 to be actuated in a forward direction and at low speed when the high/low speed relay 258 is activated for low speed and the forward relay 260 is activated for the forward direction. At step 1906, the vacuum relay 268 for the vacuum fan motor 192 is activated so as to produce a suction at the squeegee unit 166.

Thereupon, the machine can be operated to either clean the entire lane over its full length to the pin deck area, or only a partial clean, in accordance with the decision which is made at step 1908. If a full length lane clean is desired, the operator appropriately enters such instruction using the keypad 224 to commence the full lane cleaning cycle. In one suggested form, for inputing this command, the keypad 224 may be manipulated to respond to an entry of 10 feet or less, in which event the system will default to zero and will commence the full length cleaning sequence of steps.

Assuming a full lane cleaning is inputed, the next step is step 1910 where the squeegee motor is actuated for one cycle to lower the squeegee unit 166 to the lane surface. Step 1912 then asks through the squeegee down sensor whether the squeegee is in fact down in its operating position, and if the answer is "yes", the squeegee motor is deactivated at step 1914.

At step 1916 the question is asked whether the lane distance sensor indicates a count of "5" which would mean that the machine is in good contact on the lane and is seated properly. Once a "yes" answer is obtained, the spray pump pulsing motor 102 for nozzles 104 is actuated via the relay 256 at step 1918, causing cleaning liquid to be applied to the lane surface in advance of the moving machine.

At step 1920 the high/low speed relay 258 is actuated to shift the machine into a higher speed drive, which continues until the machine nears the pin deck area of the lane.

At step 1922 the question is asked whether the lane distance sensor has determined that the machine has traveled the predetermined amount (typically 35–40 feet from the foul line) so as to terminate further spraying. And if the answer is "yes", step 1924 deactivates the pulsing sprayer pump 102. When the lane distance sensor determines at step 1926 that the machine has reached the pin deck area (such as 59 feet from the foul line), the machine is shifted into low gear at step 1928.

After shifting into low, the machine continues over the last short distance of the pin deck area until the lane distance sensor at step 1930 decides that the end of the lane has been reached, at which time the drive motor 88 is turned off at step 1932. If, for any reason, the lane distance sensor does not provide an accurate reading of the distance traveled such that the machine starts to go off the end of the pin deck area, the failsafe switch is actuated at step 1934 as an alternative to the sensor actually detecting the end of the lane at step 1930, whereupon the drive motor is shut off as aforesaid at step 1932.

Once the machine has come to a complete halt at the pin deck end of the lane, a pair of simultaneous and parallel event sequences take place. In a sequence of steps for paying out fresh web material and taking up the old section of the web cloth, step 1936 causes the unwind motor 146*a* on the web supply roll 128 to be actuated via duster unwind switch 236. Step 1938 then asks whether the unwind sensor switch 152 has been operated by movement of tensioning rod 156 away form switch 154. If the answer is "yes" at step 1938, step 1940 deactivates the unwind motor 146*a* and step 1942 activates the windup motor 146*b* to actuate the takeup roll 134. Step 1944 then asks whether sensor is still on, and if the answer is "yes", as the takeup rod 156 moves to its opposite extreme, the decision is made at step 1946 to deactivate the windup motor 146*b*.

In the meantime, while the additional web length has been paid out and old web length has been wrapped up, there has been a one-half second delay in further movement of the machine at step 1948 following its coming to rest at the extreme end-of the lane. Step 1950 then activates the lane drive motor 88 in reverse and at a low speed through the high/low speed relay 258 and the reverse direction relay 262. At step 1952 the lane distance sensor checks to see if the machine has traveled in reverse until 59 feet from the foul line, and if the answer is "yes", the machine shifts to high speed at step 1954 via actuation of the high/low speed relay 258.

The machine travels back toward the foul line at high speed with the lane distance sensor looking for the foul line at step 1956. If the answer to the foul line question at step 1956 is "yes", the squeegee motor is activated at step 1958 to raise the squeegee. Once the squeegee is fully raised at step 1960, the squeegee motor is deactivated at step 1962 and the lane drive motor 88 is shifted to low speed at step 1964 so the machine starts its lane-to-lane indexing action at a slow transition speed on the approach.

From that point on, the indexing decisions are as set forth in steps 1528 through 1540 of the flow chart in FIG. 15 of the incorporated application. Therefore, such indexing steps will not be described again in this specification.

If, instead of selecting the full lane cleaning variable at step 1908 the "partial lane" variable is selected such that only part of the lane is to be cleaned, the operating sequence follows the path commencing immediately below step 1908 in FIG. 19A. If the answer at step 1966 is "yes" to the question of whether or not the lane distance sensor has a count of "5", this means that the machine is securely on the lane surface by that time and it is appropriate to commence further lane operations. Thus, the following step 1968 activates the lane drive motor 88 at high forward speed until the lane distance sensor determines at step 1990 that the machine has traveled down the lane for the programmed distance "Y" whereat the cleaning is to start.

Upon reaching the desired location on the lane, step 1972 causes the drive motor to stop, the spray pump pulser to be activated, a 3.0 second wait to be encountered, and the drive motor to again be started. When the lane distance sensor determines at step 1974 that a count of "70" has been obtained, corresponding to 70 inches, step 1976 takes place, which includes stopping of the drive lane motor, stopping of the spray pump pulser, waiting for one-half second, and then activating the lane drive motor in reverse. The machine then travels in reverse until the lane distance sensor equals a count of "70" at step 1978, whereupon the lane drive motor is stopped at step 1980 in FIG. 19B.

During this initial application of spray over 70 inches of the lane and return of the machine back to its starting place, the squeegee unit 166 has been in its raised position. The web 126, however, has been soaking up some of the liquid from the spray nozzles 104 along the full length of the cushion roll 120 so that the web 126 is fully prepared for effective action against the lane surface as the machine starts up again.

At step 1982 the lane drive motor 88 is activated in a forward mode and at high speed to commence moving the machine over the wetted lane surface, the squeegee motor 218 is activated to lower the squeegee 166 to its operating position, and the spray pump pulsing motor 102 is energized to apply additional cleaner onto the lane surface. After the lane distance sensor decides at step 1984 that the selected length of the lane surface has been cleaned, the spray pump pulsing motor is deactivated at step 1986 during the remainder of the travel of the machine down to the far end of the lane.

As the machine approaches the pin deck area so that the lane distance sensor obtains a count at step 1988 corresponding to 59 feet of travel on the lane from the foul line, the lane drive motor is shifted to low speed at step 1990 until the end of the lane is reached. At step 1992 the end of the lane is sensed by the lane distance sensor and the lane drive motor is stopped at step 1994. However, if the lane distance sensor should fail for any reason, the fail-safe switch will be activated at step 1996 to in turn stop the lane drive motor at step 1994.

As the machine sits at the pin deck end of the lane and then starts to move back toward the foul line, the machine undergoes a series of steps to pay out fresh web material and take up used web material in the same sequence as the steps 1936–1946. These are steps 1996, 1998, 2000, 2002, and 2004 in FIG. 19B.

Simultaneously with the series of web adjusting steps 1996–2004, the machine experiences a series of steps which are virtually identical to the steps 1948–1964 of FIG. 19C. These are steps 2006, 2008, 2010, 2012, 2014, 2016, 2018, 2020, 2022, and 2024 in FIG. 19B. The only difference between steps 1948–1964 and steps 2006–2024 is that in the partial lane cleaning steps of sequence 2006–2024, the lane distance sensor determines at step 2014 when the machine has returned to the initial point where cleaning liquid was first started to be applied, which is somewhat down the lane from the foul line. At that point, the squeegee motor is activated to lift the squeegee at step 2016 and to keep it raised for the remainder of the return trip at high speed. When the machine finally reaches the foul line as determined by the lane distance sensor at step 2022, the drive motor is shifted to low gear at step 2024 and the indexing sequence is commenced.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the doctrine of equivalents to determine and assess the reasonably fair scope of their invention as pertains to any apparatus not materially departing from but outside the literal scope of the invention as set out in the following claims.

What is claimed is:

1. In a machine for cleaning materials from the surface of a bowling lane, the improvement comprising:

an applicator for applying a cleaning liquid to the lane surface as the machine moves along the lane;

a pickup in trailing relationship to the applicator for removing the liquid and extraneous materials from the lane; and a wiper between the applicator and the pickup, said wiper including a transversely extending backup member and a web of absorbent material looped under said backup member for engaging the wetted lane surface and metering the applied liquid into a thin even film before it is removed by the pickup and for removing a small portion of the applied liquid before the remainder of the applied liquid is removed by the pickup.

2. In a lane cleaning machine as claimed in claim 1, said pickup including a suction head for lifting the liquid and extraneous materials from the lane surface by suction.

3. In a lane cleaning machine as claimed in claim 2, said pickup further including a lane-engaging, flexible, transverse skimming blade associated with said suction head in position for engaging and directing the liquid film into the suction head.

4. In a lane cleaning machine as claimed in claim 3, said blade being disposed behind said suction head with respect to the direction of travel of the machine when liquid is being applied;

said pickup additionally including a second lane-engaging, flexible, transverse skimming blade in front of the suction head, said second blade including means for allowing passage of the liquid film from the second blade to the suction head and rear blade in consolidated, parallel streams of the liquid.

5. In a lane cleaning machine as claimed in claim 1, said pickup being provided with means for selectively raising and lowering the pickup between operative and inoperative positions.

6. In a lane cleaning machine as claimed in claim 5; and control means operably coupled with said pickup raising and lowering means for moving the pickup between its operative and inoperative positions depending upon the position of the machine along the lane.

7. In a lane cleaning machine as claimed in claim 1, said web of absorbent material comprising a non-woven, compressed cloth.

8. In a lane cleaning machine as claimed in claim 1, said applicator including a spray nozzle located above the lane surface and disposed to project a spray of the cleaning liquid ahead of the machine as the machine moves along the lane.

9. In a lane cleaning machine as claimed in claim 8, said applicator further including means for operating said spray nozzle at intermittent intervals.

10. In a machine for cleaning materials from the surface of a bowling lane, the improvement comprising:

an applicator for applying a cleaning liquid to the lane surface as the machine moves along the lane;

a pickup in trailing relationship to the applicator for removing the liquid and extraneous materials from the lane; and a wiper between the applicator and the pickup in disposition for engaging the wetted lane surface and spreading the applied liquid into a thin film before it is removed by the pickup, said wiper including a transversely extending backup member and a web absorbent material looped under said backup member, said wiper further including a supply roller for holding a fresh supply of the web, a takeup roller for holding used portions of the web, and control mechanism operably coupled with said supply roller and said takeup roller for periodically causing a fresh portion of the web to be paid out to the backup member and a previously used portion to be shifted from the backup member onto the takeup roller.

11. In a lane cleaning machine as claimed in claim 10, said backup member being rotatable in a direction tending to feed the web toward the takeup roller, said control mechanism including means for paying out slack from the supply roller to one side of the backup member when the machine halts its movement along the lane in a forward direction, said backup member being drivable in said feeding direction by the lane surface through a small amount of rational movement during initial movement of the machine in a reverse direction along the lane whereby to pull the slack out of the web on said one side of the backup member and advance a used portion of the web as slack on the opposite side of the backup member, said control mechanism further including means for actuating the takeup roller in a manner to take up the slack on said opposite side of the backup member following rotation of the backup member.

12. In a lane cleaning machine as claimed in claim 11, said control mechanism further including means responsive to the amount of slack in the web for actuating the supply and takeup rollers.

13. In a lane cleaning machine as claimed in claim 10, said backup member including a resilient cushion directly underlying the web in the area that the web engages the lane surface.

14. In a machine for cleaning materials from the surface of a bowling lane, the improvement comprising:

an applicator for applying a cleaning liquid to the lane surface as the machine moves along the lane, said applicator including a spray nozzle disposed to project a spray of cleaning liquid onto the lane surface at periodic intervals in advance of the machine as the machine moves along the lane;

a pickup in trailing relationship to the applicator for removing the liquid and extraneous materials from the lane said pickup including a backing suction head having an inlet disposed for movement along the lane surface in closely vertically spaced relationship to the surface and a resilient, transverse skimmer blade located closely behind said inlet in disposition for engaging the lane surface and skimming the liquid film and extraneous material into the inlet; and a wiper between the applicator and the pickup in disposition for engaging the wetted lane surface and spreading the applied liquid into a thin film before it is removed by the pickup, said wiper including a web of non-woven, compressed cloth looped under a transversely extending backup member in disposition for engaging the lane surface as the machine moves alone the lane, said web of cloth being provided with mechanism for periodically paying out a fresh section of the cloth for engagement with the lane surface and for taking up used sections of the cloth, said vacuum head and skimmer blade having apparatus operably associated therewith for shifting the head and blade as a unit between operative and inoperative positions;

said machine further including control means operably coupled with said spray nozzle, said cloth payout and takeup mechanism, and said vacuum head and skimmer blade shifting apparatus for actuating the nozzle, mechanism and apparatus at predetermined points in the movement of the machine along the lane.

15. In a lane cleaning machine-as claimed in claim 14, said control means being operable to actuate the spray nozzle for an initial application of cleaning liquid to the lane while the machine is still behind a foul line and resting upon an approach surface that precedes the lane, said control means being further operable to maintain the vacuum head and skimmer blade in said inoperative position during at least a portion of the time that the machine is on the approach surface and to maintain the vacuum head and skimmer blade in said operative position during the time that the machine moves along the lane toward a pin deck area of the lane remote from the foul line, said control means being additionally operable to actuate said payout and takeup mechanism after reaching said pin deck area of the lane.

16. In a lane cleaning machine as claimed in claim 15, said control means being operable to prevent actuation of said spray nozzle during return movement of the machine from the pin deck area of the lane toward the foul line.

17. In a lane cleaning machine as claimed in claim 16, said control means including a programmable microcomputer.

18. In a machine for cleaning extraneous materials from the surface of a bowling lane, an improved wiping cloth assembly comprising:

a transversely extending backup member;

a web of absorbent material looped under said backup member in position for wiping engagement with the lane surface as the machine moves along the lane;

a supply roller for holding a fresh supply of the web;

a takeup roller for holding used portions of the web; and control mechanism operably coupled with said rollers for periodically causing a portion of the web to be paid out to the backup member and a previously used portion of the web to be shifted from the backup member onto the takeup roller, said backup member being rotatable in a direction tending to feed the web toward the takeup roller, said control mechanism including means for paying out slack from the supply roller to one side of the backup member when the machine halts its movement along the lane in a forward direction, said backup member being drivable in said feeding direction by the lane surface through a small amount of rotational movement during initial movement of the machine in a reverse direction along the lane whereby to pull the slack out of the web on said one side of the backup member and advance a used portion of the web as slack on the opposite side of the backup member, said control mechanism further including means for actuating the takeup roller in a manner to take up the slack on said opposite side of the backup member following rotation of the backup member.

19. In a lane cleaning machine as claimed in claim 18, said control mechanism further including means responsive to the amount of slack in the web on said opposite side of the backup member for actuating the takeup roller.

20. In a lane cleaning machine as claimed in claim 19, said control mechanism further including a spring-loaded actuator engagable with used portions of the web on said opposite side of the backup member, and a pair of spaced apart, mutually opposed switches in disposition for alternate actuation by said actuator depending upon the extent of slack existing in the web on said opposite side of the backup member whereby to control actuation and non-actuation of said takeup roller.

21. In a lane cleaning machine as claimed in claim 18, said backup member including a resilient cushion underlying the web in the area that the web engages the lane surface.

22. In a machine for cleaning extraneous materials from the surface of a bowling lane, an improved wiping cloth assembly comprising:

a transversely extending backup member;

a web of absorbent material looped under said backup member in position for wiping engagement with the lane surface as the machine moves along the lane;

a supply roller for holding a fresh supply of the web;

a takeup roller for holding used portions of the web; and control mechanism operably coupled with said rollers for periodically causing a previously used portion of the web to be shifted from the backup member onto the takeup roller and a fresh portion of the web to be paid out to the backup member, said control mechanism including:

means for rotating the takeup roller to shift a used portion of the web away from one side of the backup member and to advance a fresh portion of the web towards the opposite side of the backup member, and means for rotating the supply roller for paying out a portion of the web from the supply roller to the opposite side of the backup member.

23. In a lane cleaning machine as claimed in claim 22, said means for rotating the takeup roller including a motor.

24. In a lane cleaning machine as claimed in claim 22, said means for rotating the supply roller including a motor.

* * * * *